United States Patent [19]

Ramnesten

[11] 4,428,222

[45] Jan. 31, 1984

[54] COLD FORGING MANDREL WITH THREADS

[75] Inventor: Ivan O. Ramnesten, Eskilstuna, Sweden

[73] Assignee: Förenade Fabriksverken, Eskilstuna, Sweden

[21] Appl. No.: 341,664

[22] Filed: Jan. 22, 1982

[30] Foreign Application Priority Data

Feb. 3, 1981 [SE] Sweden ..... 81/00773

[51] Int. Cl.[3] ..... B21J 13/02

[52] U.S. Cl. ..... 72/479; 72/370; 72/398; 72/209; 10/152 R

[58] Field of Search ..... 72/76, 370, 402, 398, 72/401, 139, 208, 479; 10/152 R

[56] References Cited

U.S. PATENT DOCUMENTS 3,656,197 4/1972 Van Vleet ..... 10/152

FOREIGN PATENT DOCUMENTS 13943 6/1855 France ..... 72/139

*Primary Examiner*—Francis S. Husar
*Assistant Examiner*—David B. Jones
*Attorney, Agent, or Firm*—James E. Nilles

[57] ABSTRACT

A mandrel for the production of internally threaded tubes or cylinders by the cold forging of a forging blank (3) around an externally threaded mandrel (2). The mandrel is formed with a conicity of 0.2–1.0% or preferably 0.4–0.7% and the flanks of the mandrel's threads can be ground so that the thread width is least at the mandrel's narrow end. The reduction of flank width can be 0.1–0.4% of preferably 0.2–0.3% for a length unit of the mandrel with the above named conicity. Preferably even the inner diameter of the mandrel's thread is made 0–0.5% less than the required inside diameter in the tube's or cylinder's thread.

8 Claims, 5 Drawing Figures

COLD FORGING MANDREL WITH THREADS

BACKGROUND OF THE INVENTION

The present invention generally concerns cold forging and the invention concerns more specially a threaded mandrel for the cold forging of internal threads in a tube or cylinder.

Internal threads in tubes or cylinders have earlier been produced by cutting methods such as turning, shaping, slotting etc. The production of internal threads in tubes and cylinders etc. has recently also been accomplished by cold forging, whereby a tube or cylinder is forged around a mandrel which, after the process, is removed from the tube or cylinder.

Cold forging involves several advantages compared to cutting methods. By cold forging, a finer surface finish can be achieved than with cutting methods, the material becomes harder as a result of the fact that metal fibers are not cut off and that a certain packing of the material is gained by the mechanical working, internal stresses from earlier handling are eliminated, the threads can be formed to extremely fine tolerances and cold forged products are produced with an even and high quality etc.

Cold forging around a mandrel however does present some problems, specially the problem of removing the mandrel after the cold forging process. By cold forging the workpiece is pressed so hard against the mandrel that material displacement occurs in the workpiece and the material is pressed into the mandrel's threads or other various shaped pits. Depending on the material's elasticity, the tube or cylinder and the mandrel will be radially pressed against each other very hard and this makes it very difficult to remove the mandrel from the tube or cylinder. Cold forging is usually effected by a progressive working of the tube or cylinder by using forging hammers which are run over the workpiece from one end to the other. During this hammering the tube or cylinder will lengthen in a direction which is opposite the direction of movement of the workpiece, and this lengthening of the material is the cause of axial loads which arise between the forged workpiece and the mandrel and which loads make it even more difficult to release the mandrel from the workpiece.

The invention is intended to eliminate these problems and to provide a mandrel for the production of internal threads in a tube or cylinder by cold forging a forging blank around the mandrel.

SUMMARY OF THE PRESENT INVENTION

According to the invention the mandrel's threads are formed slightly conical so that an angle of clearance is attained between the mandrel and the forged workpiece and the mandrel releases after only a very little rotating movement between the mandrel and the workpiece. Also, according to a preferred embodiment of the invention the flanks of the mandrel's threads are ground so that they continuously become thinner in the same direction as the mandrel's convergence, whereby the thread flanks also loosen from the cold forged cylinder after a short twist of the cylinder relative to the mandrel.

With a further preferred embodiment of the invention the mandrel is parted at or near its axial centre and each half of the mandrel is formed slightly conical, tapering in a direction inwards towards the parting line and correspondingly the flanks of the threads are ground so that the threads are thinnest at the mandrel's axial parting line. Loosening of the mandrel is effected in this case by releasing the halves of the mandrel in each direction.

DESCRIPTION OF THE DRAWINGS

The invention shall now be described in closer detail with references made to the accompanying drawings.

The drawings show in FIG. 1 a diagrammatic and axial section of a device for the production of internal threads by cold forging a cylinder.

DESCRIPTION OF THE INVENTION

Figure 1:
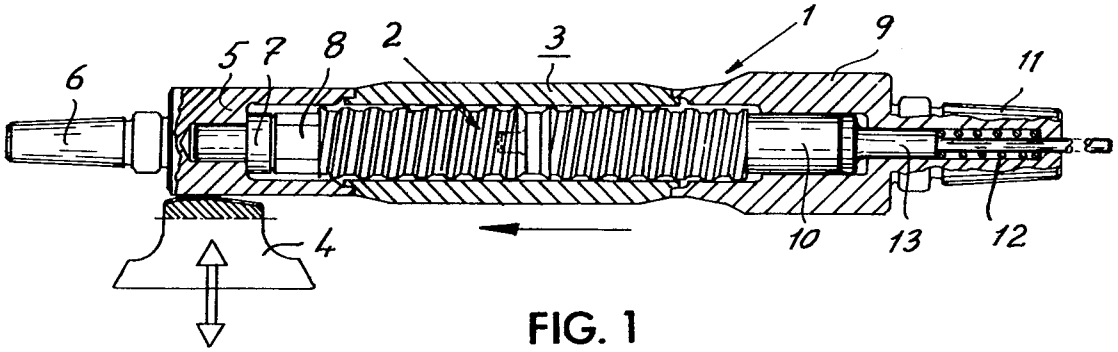

The machine shown in FIG. 1 for the cold forging of internally threaded tubes or cylinders generally comprises a forging tool 1, in which a mandrel 2 and a forging blank 3 are set up. The forging tool 1 with the mandrel 2 and forging blank 3 are arranged to be rotated and run between a number of forging hammers 4 positioned around the tool, which are driven by eccentrics, not shown, and which by cold hammering work the forging blank 3, which by material displacement is formed around the mandrel's 2 outer form, while the forging blank's outside is given an even surface.

The tool 1 comprises an end socket 5 with a journal 6, which is supported in a ball bearing, not shown. The inside shape of the socket 5 is formed to accept an end positioner 7 for the mandrel. Against the end positioner 7 lies one end 8 of the mandrel and by using various thicknesses of end positioner the mandrel's position in relation to the forging blank can be adjusted.

The other end of the tool 1 comprises a driver 9, in which the other end 10 of the mandrel is displaceably supported. The driver 9 is formed with a shaft end 11 upon which a means for rotating the forging tool 1 is applied. The driver and shaft end 11 comprises a spring 12 loaded ram 13 which lies against the end 10 of the mandrel and loads the mandrel 2 against the end positioner 7. The end socket 5 and driver 9 are at their inside ends faced towards each other, formed to hold the forging blank 3.

The tool and forging blank are held together by hydraulic or other means, pressing the end socket 5 and driver 9 towards each other with such force that the end socket 5, forging blank 3 and driver 9 are held steadily together during the cold forging process. As a result of the lengthening of the workpiece during cold forging, the driver 9 is displaced away from the end socket 5, while the spring loaded ram 13 remains pressed towards the end socket.

Figure 2:
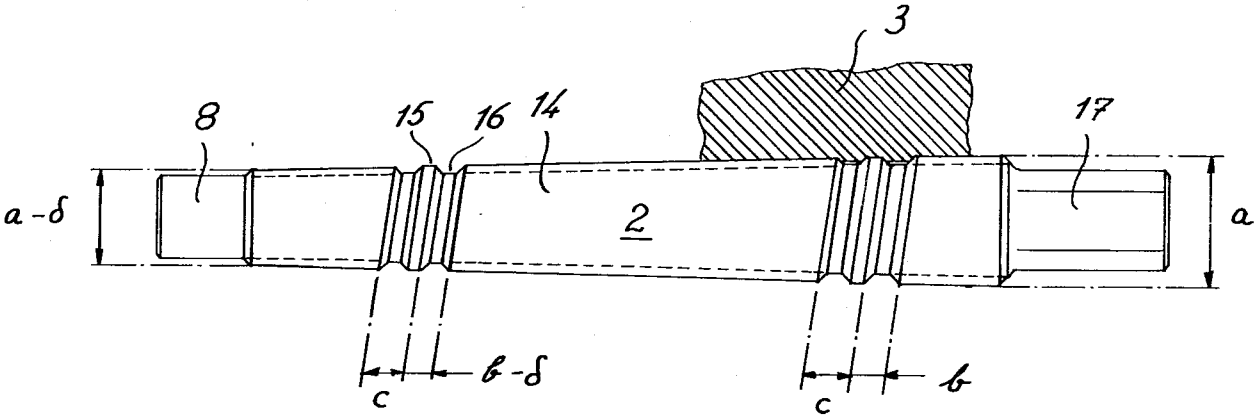
FIG. 2 shows diagrammatically a simple embodiment of a mandrel according to the invention in an exaggerated scale.

By use of the described appliance, any form, type or size of inside profiling of a tube or cylinder can be achieved providing that the mandrel's profile or the profile of each part of the mandrel is such that it can be drawn out of the forged product. The invention is specially suitable for the production of internally threaded tubes or cylinders. A simple embodiment of the mandrel for the production of a continuously threaded cylinder is shown in FIG. 2. In this case the mandrel is formed from a single bar 14 with external thread. The thread is formed with tops 15 and bases 16. The shown embodiment is formed with a trapezoid or buttress thread, but it is obvious that threads can be triangular, square or round or any other type.

During cold forging the workpiece 3 is worked by the forging hammers 4 with such force that the workpiece's material by displacement is pressed wholly or partly into the areas between the thread tops and by a continual forging of the forging blank from one end to the other, a lengthening of the workpiece occurs in the same direction as the forging hammers progress relatively along the workpiece. During forging therefore the workpiece will be pressed with considerable radial and axial forces against the mandrel, and this causes many problems when loosening the mandrel from the forged product.

To facilitate the loosening of the mandrel out of the forged product, the mandrel, according to the invention, is formed slightly conical. The cone can be so little that it in no way is detrimental to the threads quality or bolting capability. The coning of long threads should obviously be less than with short threads and different materials in the tube or cylinder can demand varying conicity. However it is generally adequate with a conicity of 0.2–1.0% or preferably 0.4–0.7%, that is a decrease of the threads outer diameter of between 0.2–1 or preferably 0.4–0.7 units on a thread length of 100 units. By making the thread in this way slighty conical, the mandrel can be removed from the forged product by loosening with a very little twist of the mandrel relative to the product, so that the mandrel becomes immediately free for screwing out.

In order to reduce the removing force further, the flanks of the threads can be ground in such a way that the width of the thread lessens in proportion to the mandrel's decreasing outer diameter, that is, so that the thread width is least at the end of the mandrel which has the least diameter. Decrease of the thread width can be 0.1–0.4% or preferably 0.2–0.3% for a length unit of a mandrel with a conicity of 0.2–1.0% as mentioned above.

The necessary loosening force can also be reduced further by forming the mandrel with the thread base somewhat deeper than the required thread height in the forged product. The profile depth of the thread should thus be one or several tenths of a millimeter more than the required profile depth in the forged product. As an indication, the mandrel's inner diameter should be between 0 and 0.5% less than the required inner diameter of the forged product.

To enable the mandrel to be removed from the forged product, its outside end can be formed as a hexagon for the application of a spanner. Removal can be made with an impact machine whereby the mandrel after only a very little rotation is practically completely free from the forged product and can easily be drawn out.

Figure 3:
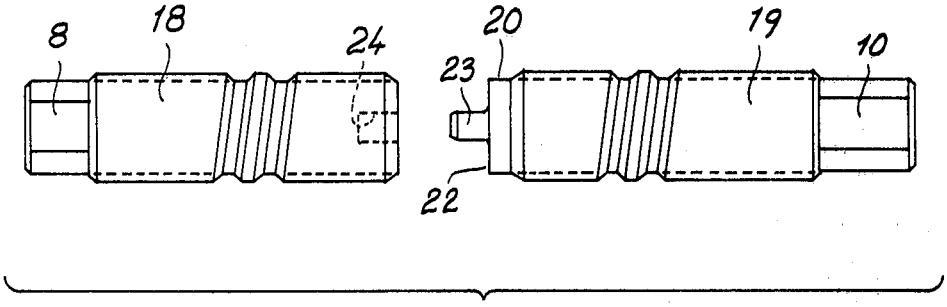
FIG. 3 shows an axially parted mandrel according to the invention.

FIG. 3 shows an alternative embodiment of the mandrel shown in FIG. 2. The mandrel according to FIG. 3 is axially parted into two halves 18, 19 and the mandrel at its axial centre is shaped with a groove 20 intended to produce a central circular rib in the final forged product. In this case the mandrel is adapted for production of a threaded joining sleeve for threaded rods, for example drilling rods, whereby the central rib 21 (FIG. 5) ensures that the rod cannot be screwed in further than to the middle of the sleeve.

Both threaded halves 18, 19 are slightly conical in the same way as described above, tapering from respective ends 8, 10 in the direction towards the parting line 22, which is placed at one side of the circular groove 20. The mandrel halves 18, 19 are loosely connected to each other by a dowel 23 in the one half and a corresponding hole 24 in the other half. The dowel 23 and hole 24 can be given some play, so that the mandrel halves 18, 19 are self-centering during the forging process.

Figure 4:
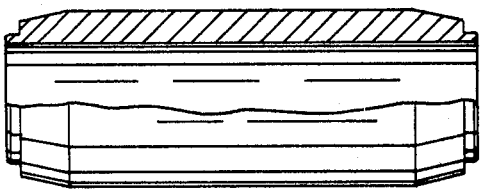
FIG. 4 shows a cylindrical forging blank for the production by cold forging of an internally threaded joining sleeve, shown partly cut away.
Figure 5:
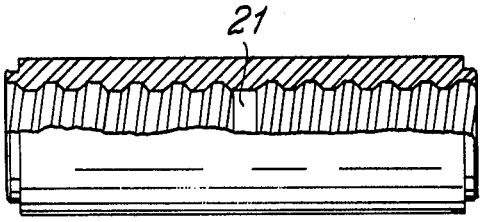
FIG. 5 shows in a similar way the final forged joining sleeve.

FIG. 4 shows a forging blank for the production of a joining sleeve for threaded rods, and FIG. 5 shows a final forged product produced by the mandrel shown in FIG. 3. Removal of the mandrel halves 18, 19 out of the forged product is obviously made in each direction from the product.

I claim:

1. A mandrel insertable into a tubular forging blank for cooperation with forging hammers which repeatedly radially impact against the interior of the blank, all around it and along its length, to cold form the blank into a substantially tubular product that has an internal thread extending axially from one of its ends, said mandrel having an external thread which defines said internal thread and which extends along the mandrel from an end portion thereof that is adjacent to said end of the blank when the hammers are acting thereon, said mandrel being characterized by:

A. said mandrel being slightly conical along the length of said external thread, with taper from its said end portion to facilitate loosening the mandrel from the tubular product for screwing it out of said end thereof; and B. said external thread having a width between its flanks which decreases progressively along it in the direction away from said end portion of the mandrel.

2. The mandrel of claim 1, further characterized in that the conicity of the mandrel along said external thread is between 0.2% and 1.0%.

3. The mandrel of claim 2 wherein the decrease in width of the thread between its flanks is between 0.1% and 0.4%.

4. The mandrel of claim 1, further characterized in that the depth of the profile of said external thread is slightly more than the required depth of profile of said internal thread of the tubular product.

5. The mandrel of claim 4 wherein the depth of profile of said external thread is on the order of 0.5% greater than the required depth of profile of said internal thread of the finished product.

6. The mandrel of claim 1, having a second end portion with a second external thread extending axially along it from said second end portion towards the first mentioned external thread, said mandrel being axially separable intermediate its ends into two halves, each of which has one of said external threads thereon, further characterized by:

(1) said mandrel being slightly conical along the length of said second external thread, with taper from its said second end portion; and (2) said second external thread having a width between its flanks which decreases progressively along it in the direction away from said second end portion.

7. The mandrel of claim 6 wherein said halves of the mandrel have cooperating means whereby they are loosely connected in substantially coaxial relationship but are free for limited radial play relative to one another.

8. The mandrel of claim 7 wherein one of said mandrel halves has a reduced diameter portion adjacent to said cooperating means, for defining an internal circumferential rib in the tubular product.

* * * * *